US006957034B2

(12) United States Patent
Saito et al.

(10) Patent No.: US 6,957,034 B2
(45) Date of Patent: Oct. 18, 2005

(54) IMAGE FORMING APPARATUS HAVING INTERMEDIATE TRANSFER BELT AND PRIMARY TRANSFER ROLLER

(75) Inventors: Masashi Saito, Hino (JP); Hiroaki Miho, Hachioji (JP); Mikihiko Takada, Hino (JP); Shigetaka Kurosu, Hino (JP); Hiroshi Morimoto, Akiruno (JP); Satoshi Nishida, Saitama (JP)

(73) Assignee: Konica Minolta Holdings, Inc., Tokyo (JP)

( * ) Notice: Subject to any disclaimer, the term of this patent is extended or adjusted under 35 U.S.C. 154(b) by 36 days.

(21) Appl. No.: 10/792,854

(22) Filed: Mar. 5, 2004

(65) Prior Publication Data

US 2004/0179872 A1 Sep. 16, 2004

(30) Foreign Application Priority Data

Mar. 10, 2003 (JP) ..... 2003-063002

(51) Int. Cl.[7] ..... G03G 15/16

(52) U.S. Cl. ..... 399/302; 399/313; 399/278; 399/165

(58) Field of Search ..... 399/302, 303, 399/313, 278, 279, 165, 101

(56) References Cited

U.S. PATENT DOCUMENTS

| | | | | | |
|---|---|---|---|---|---|
| 5,671,464 | A | * | 9/1997 | Kubota | 399/101 |
| 6,088,559 | A | * | 7/2000 | Costanza et al. | 399/165 |
| 6,321,052 | B1 | * | 11/2001 | Yamashina et al. | 399/165 |
| 6,625,410 | B2 | * | 9/2003 | Sato et al. | 399/165 |
| 6,795,667 | B2 | * | 9/2004 | Nakazawa et al. | 399/111 |
| 6,834,177 | B2 | * | 12/2004 | Saito et al. | 399/313 |

* cited by examiner

*Primary Examiner*—Louis Arana
(74) *Attorney, Agent, or Firm*—Finnegan, Henderson, Farabow, Garrett & Dunner, L.L.P.

(57) ABSTRACT

An image forming apparatus having therein an image carrier, an intermediate transfer belt is trained about plural rollers and is located at a position where it comes in contact with the image carrier, a primary transfer roller that is arranged to face the image carrier through the intermediate belt for the purpose of transferring toner on the image carrier onto the intermediate transfer belt, wherein the following expression holds when Ft (kgf) represents tension of the intermediate transfer belt, Fr (kgf) represents pressing force of primary transfer roller and d (mm) represents a shift amount for the image carrier and the primary transfer roller, $$Fr \geqq (0.05 \times Ft + 0.11) \times d - 0.3.$$

5 Claims, 5 Drawing Sheets

IMAGE FORMING APPARATUS HAVING INTERMEDIATE TRANSFER BELT AND PRIMARY TRANSFER ROLLER

BACKGROUND OF THE INVENTION

The present invention relates to an image forming apparatus such as an electrophotographic copying machine, a printer, or a facsimile device, and in particular, to an image forming apparatus wherein a toner image on an image carrier is transferred onto an intermediate transfer belt as a primary transfer, and then, the toner image is transferred onto a transfer material as a secondary transfer.

In the conventional primary transfer means wherein an intermediate transfer belt is brought into contact with an image carrier, and the intermediate transfer belt is pressed from its inside by a transfer means such as a transfer roller for transferring, if primary transfer roller 25 is at the position that is exactly the left of photoreceptor 10 as shown in FIG. 2(*a*), a vibration from side to side is caused on primary transfer roller 25 by rotations of the photoreceptor 10 and of the intermediate transfer belt 20. Thus, this vibration causes transfer unevenness easily, and causes a problem that an electric field is formed between the intermediate transfer belt 20 and photoreceptor 10 at vicinity R where the intermediate transfer belt 20 starts making contact with photoreceptor 10, and this electric field causes toner on the photoreceptor 10 to fly in the direction of arrow t, resulting in the so-called dust phenomenon of a toner image. To solve this problem, there has been taken a structure to provide a pressure-contact member which brings a photoreceptor into contact with an intermediate transfer belt more closely, on the upstream side of a transfer means, or there has been taken a measure to shift primary transfer roller 25 to the downstream side by a certain amount as shown with dotted lines, for reducing an effect of an electric field at vicinity R where the intermediate transfer belt starts touching photoreceptor 10 (Japanese TOKKAIHEI No. 9-152791).

However, despite the aforementioned technology, there are some cases where transfer efficiency cannot be secured sufficiently because of vibration of the primary transfer roller caused by fluctuation of tension of the intermediate transfer belt, deviation of the image carrier and waviness of the intermediate transfer belt.

An object of the invention is to provide an image forming apparatus wherein effects of vibration of the primary transfer roller, deviation of the image carrier and of waviness of the intermediate transfer belt are avoided, dust phenomenon of toner images for characters and lines and transfer unevenness are not caused, and stable and excellent transfer efficiency can be kept.

An image forming apparatus having therein an image carrier, an intermediate transfer belt that is trained about plural rollers and is located at a position where it comes in contact with the image carrier, a primary transfer roller that is arranged to face the image carrier through the intermediate belt for the purpose of transferring toner on the image carrier onto the intermediate transfer belt, wherein the following expression holds when Ft (kgf) represents tension of the intermediate transfer belt, Fr (kgf) represents pressing force of primary transfer roller and d (mm) represents a shift amount for the image carrier and the primary transfer roller, $$Fr \geqq (0.05 \times Ft + 0.11) \times d - 0.3.$$

Figure 2:
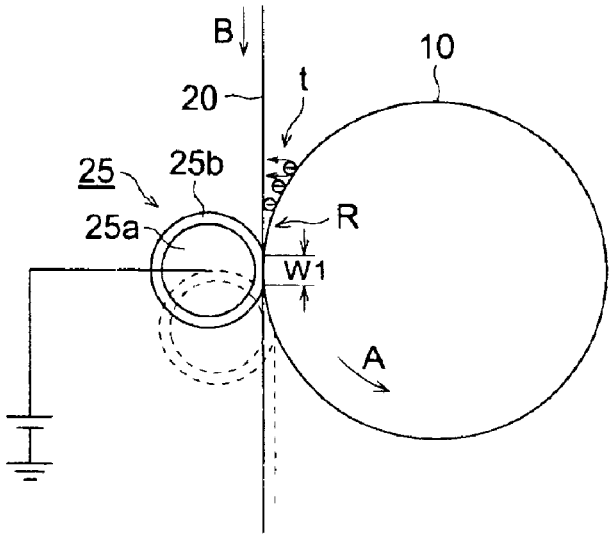
FIG. 2 (a) PRIOR ART
Figure 2:
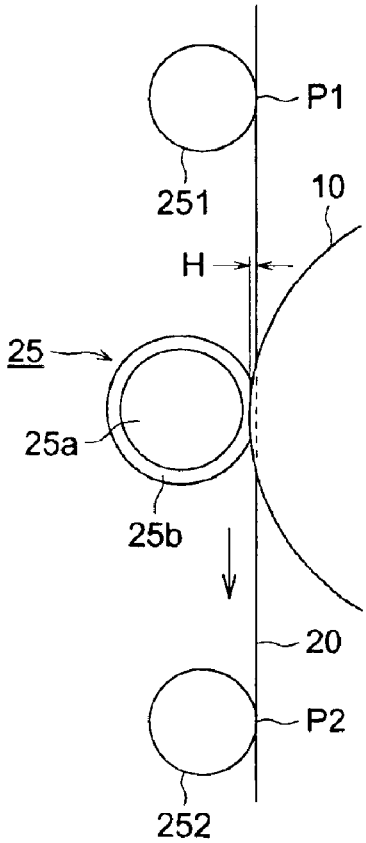
Figure 2:
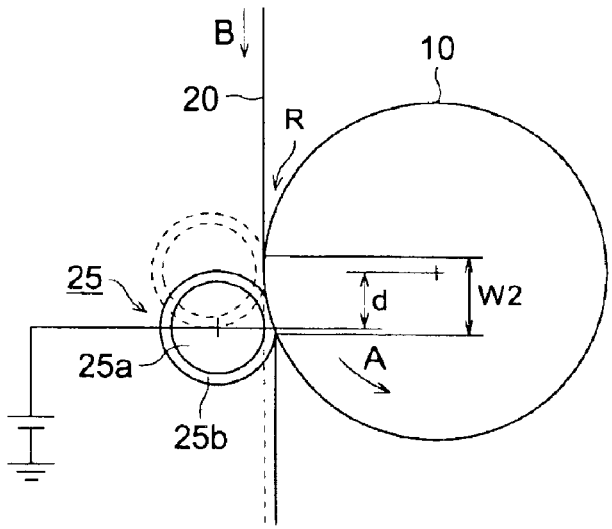

Each of FIGS. 2(*a*)–2(*c*) is an enlarged view for illustrating positional relationship for a photoreceptor, an intermediate transfer belt and a primary transfer roller.

Figure 3:
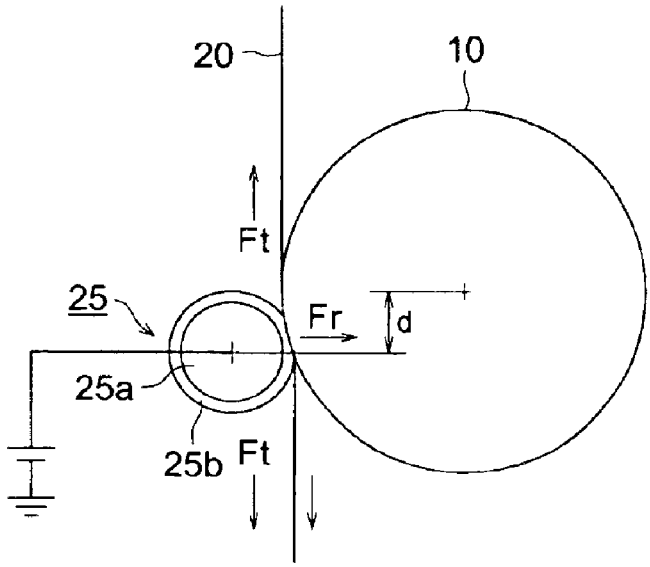

FIG. 3 is a diagram for illustrating positional relationship between tension of the intermediate transfer belt and pressing force of the primary transfer roller.

Figure 4:
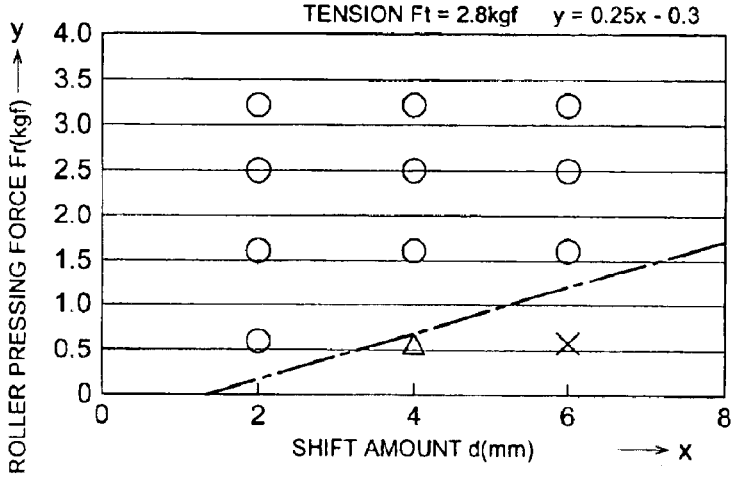
Figure 4:
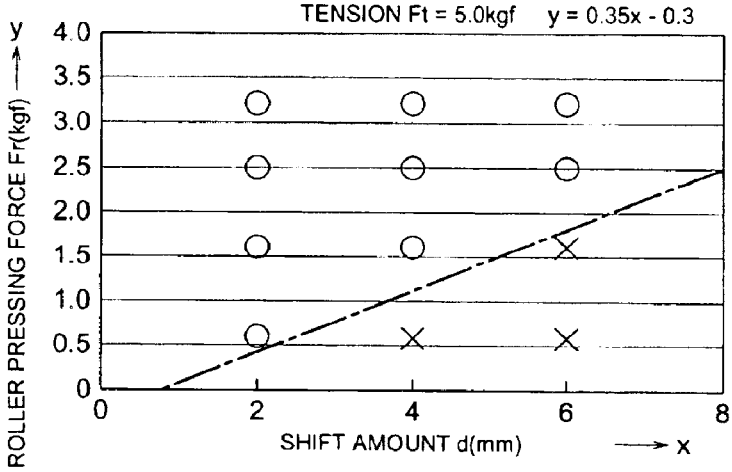
Figure 4:
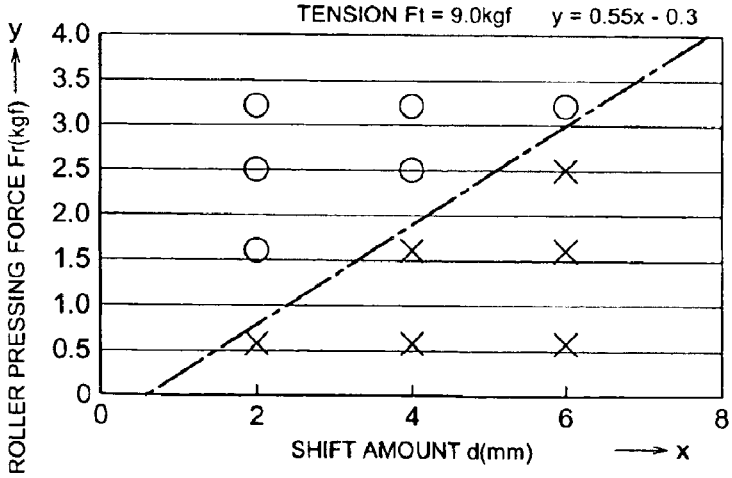

Each of FIGS. 4(*a*)–4(*c*) is a graph showing the relationship between a shift amount and roller pressing force wherein a parameter is tension of the intermediate transfer belt.

Figure 5:
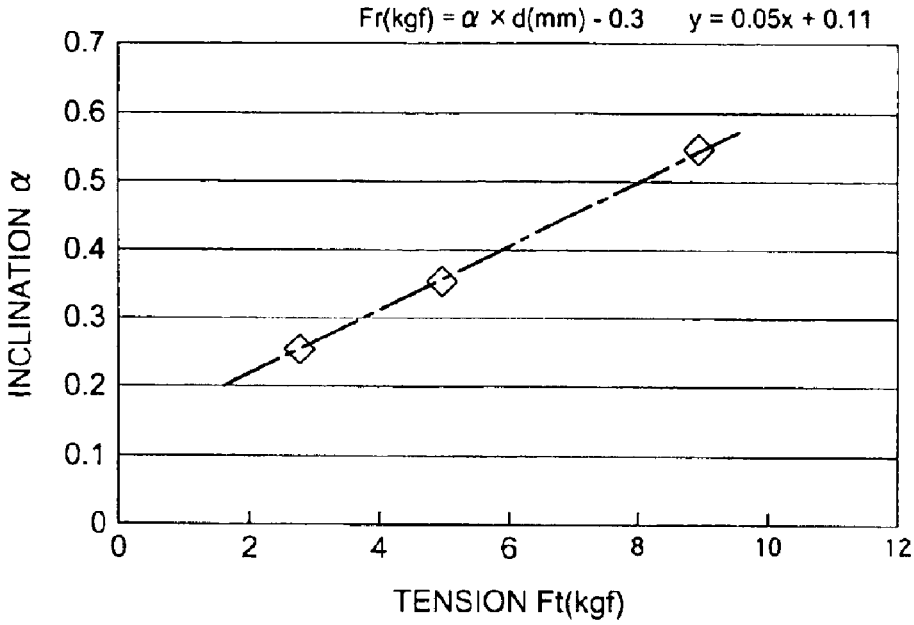

FIG. 5 is a graph showing relationship between an inclination (constant) and tension obtained from results of experiments shown in FIGS. 4(*a*), 4(*b*) and 4(*c*).

DETAILED DESCRIPTION OF THE PREFERRED EMBODIMENT

An example of the embodiment relating to the invention will be explained as follows, referring to the drawings, and an image forming apparatus will be explained first by the use of FIG. 1.

Incidentally, terminologies used in the present specification do not limit technical ranges of the invention.

Figure 1:
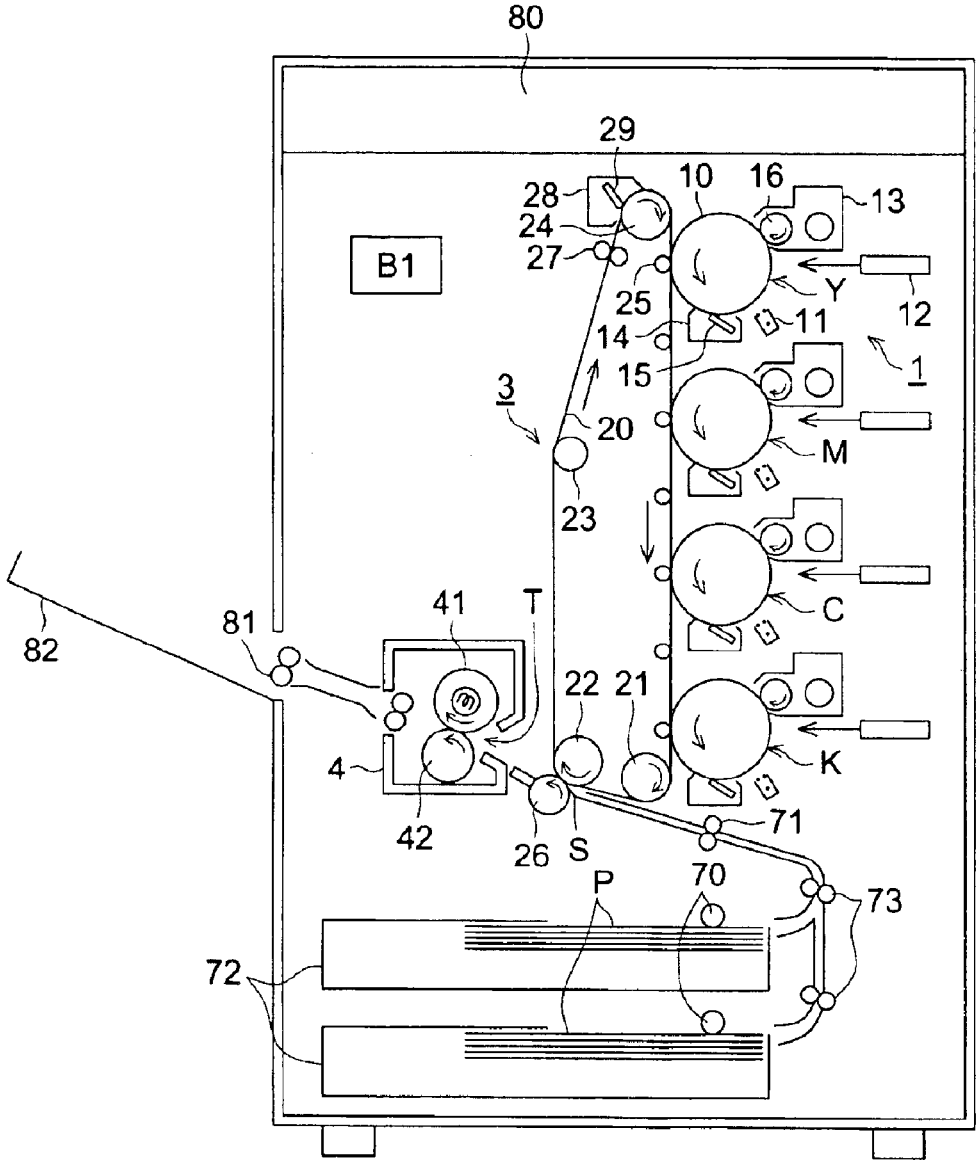
FIG. 1 is a schematic diagram showing an example of the total structure of an image forming apparatus.

FIG. 1 is a schematic diagram showing an example of the total structure of the image forming apparatus.

In the drawing, the numeral 10 represents a photoreceptor serving as an image carrier wherein a conducting layer and an a-Si layer or a photosensitive layer of organic photoconductor (OPC) are formed on an outer circumference of a cylindrical metal base body made by aluminum material, for example, and it rotates counterclockwise as shown by an arrow in the drawing, with its conducting layer that is kept to be grounded.

The numeral 11 represents a scorotron charger serving as a charging means, 12 represents a writing unit serving as an image writing means and 13 represents a developing unit serving as a developing means that has cylindrical developing sleeve 16 which is away from a circumference of the photoreceptor 10 by a prescribed distance and is made of non-magnetic stainless or aluminum material and rotates in the same direction as that of the photoreceptor 10 in terms of peripheral portions of the developing sleeve and the photoreceptor at the position where the developing sleeve 16 is closest to the photoreceptor 10.

The numeral 14 represents a cleaning unit for cleaning a surface of photoreceptor 10, 15 represents a cleaning blade, 16 represents a developing sleeve, and image forming apparatus 1 is composed of photoreceptor 10, scorotron charger 11, developing unit 13 and cleaning unit 14. Since the mechanical structure of image forming means 1 for each color is the same as those for other colors, reference symbols are given to the structure of only Y (yellow) system in the drawing, and reference symbols are omitted for structural factors of M (magenta), C (cyan) and K (black).

An arrangement of image forming means 1 for each color is in the order of Y, M, C and K in the direction that is the same as the running direction of intermediate transfer belt 20, and each photoreceptor 10 is in contact with a tense surface of the intermediate transfer belt 20 and rotates in the same direction as the running direction of the intermediate transfer belt 20 and at the same linear speed as that of the intermediate transfer belt 20, at the position of contact.

The numeral 20 represents an intermediate transfer belt which is an endless belt having a surface resistance value of $10^7$–$10^{13}$ Ω/□ and its example is a two-layer seamless belt wherein fluorine-coating is conducted to be of a thickness of 5–50 μm as a toner filming preventive layer preferably on the outer side of a substrate of a semi-conductive film having a thickness of 0.1–1.0 mm in which conductive materials are dispersed in engineering plastic such as modified polyimide, thermosetting polyimide, ethylene-tetrafluoroethylene copolymer, poly vinylidene fluoride and nylon alloy. In addition to the foregoing, it is also possible to employ a semi-conducting rubber belt having a thickness of 0.5–2.0 mm wherein conducting materials are dispersed in silicone rubber or urethane rubber.

The intermediate transfer belt 20 is trained about driving roller 21, grounding roller 22, tension roller 23, neutralizing roller 27, driven roller 24 and primary transfer roller 25, and belt unit 3 is composed of the rollers stated above, the intermediate transfer belt 20 and cleaning unit 28.

The intermediate transfer belt 20 is rotated and moved by a rotation of the driving roller 21 that is made by an unillustrated driving motor.

Electric signals corresponding to image data coming from reading apparatus 80 are converted into optical signals by image forming laser, and are projected on photoreceptor 10 by writing unit 12.

The numeral 25 represents a primary transfer roller which is applied with DC having polarity opposite to that of toner, and has a function to transfer a toner image formed on photoreceptor 10 onto intermediate transfer belt 20, and has a structure wherein an elastic layer such as sponge is wound round a cored bar. A value of resistance of the primary transfer roller 25 is in a range of $10^5$–$10^9$ Ω.

The numeral 26 represents a secondary transfer roller capable of being brought into contact with grounding roller 22 or being canceled from contact with the grounding roller 22, and it transfers a toner image formed on intermediate transfer belt 20 onto transfer material P again.

The numeral 28 represents a cleaning unit that is provided to face driven roller 24 through intermediate transfer belt 20. After transferring a toner image onto a transfer material P, charges of residual toner on the intermediate transfer belt 20 are weakened by neutralizing roller 27 that is impressed with AC voltage on which DC voltage having polarity that is the same as or opposite to that of toner is superposed, thus, toner remaining on a circumference is removed by cleaning blade 29.

The numeral 4 represents a fixing unit that has therein heating roller 41 serving as a heating member and pressure roller 42 serving as a pressure member.

The numeral 70 represents a sheet feeding roller, 71 represents a timing roller, 72 is a sheet cassette and 73 is a conveyance roller.

Now, primary transfer relating to the invention in which a toner image on photoreceptor 10 is transferred onto intermediate transfer belt 20 will be explained.

Each of FIGS. 2(*a*)–2(*c*) is a diagram for illustrating positional relationship for a photoreceptor, an intermediate belt and a primary transfer roller. Incidentally, in each drawing shown below, the same members (means) as those illustrated before are assumed to be given the same symbols.

FIG. 2(*a*) is a diagram wherein the primary transfer roller is in the rightmost position of a photoreceptor.

FIG. 2(*b*) is a diagram wherein the primary transfer roller is deviated toward the downstream side.

In each of FIGS. 2(*a*) and 2(*b*), 25(*a*) and 25(*b*) represent respectively a cored bar and an elastic layer of the primary transfer roller 25.

The photoreceptor 10 rotates in the direction of arrow A, and intermediate transfer belt 20 goes around in the direction of arrow B to move.

The invention is characterized to obtain excellent transferability by prescribing pressing force Fr of the primary transfer roller 25 against intermediate transfer belt 20, tension Ft of the intermediate transfer belt 20, and amount of shifting the primary transfer roller 25 d (see FIG. 2(*b*)) so that $Fr \geqq (0.05 \times Ft + 0.11) \times d - 0.3$ may stand, in addition to the structure wherein a degree of adhesion between the photoreceptor and the intermediate transfer belt is enhanced at the upstream side of the transfer means, by increasing a nip portion (a portion where the intermediate belt comes in contact with the photoreceptor) from W1 to W2, by shifting the primary transfer roller by a prescribed amount toward the downstream side in the direction of going around from the point of contact of the intermediate transfer belt. Incidentally, the relationship stated above is confirmed by the results of experiments which will be stated later. The shifting amount d means a length by which the center of the primary transfer roller is shifted from the position that is exactly the left of the photoreceptor as shown in FIG. 2(*a*) to the downstream side in the direction of going around of the intermediate transfer belt as shown in FIG. 2(*b*), and it is preferable that d satisfies $1.5\ \text{mm} \leqq d \leqq 10.0\ \text{mm}$.

FIG. 2(*c*) is a diagram for illustrating an amount of protrusion of a photoreceptor.

In FIG. 2(*c*), it is preferable that the primary transfer roller 25 is arranged so that $0 \leqq H \leqq 1.0$ may stand under the assumption that H (mm) represents an amount of protrusion of the image carrier through a straight line connecting points P1 and P2 where the intermediate transfer belt 20 is in contact with roller 251 and roller 252 which are positioned respectively to be just upstream and just downstream from photoreceptor 10 about which the intermediate transfer belt 20 is trained. This means configuration to make the intermediate transfer belt 20 and the photoreceptor 10 to be in close contact each other even when the primary transfer roller 25 is not pressing, for the purpose of lightening a load for the primary transfer roller 25, under the condition that the primary transfer roller 25 presses the intermediate transfer belt 20 against the photoreceptor 10 resisting tension of the intermediate transfer belt 20.

Next, there will be explained experiments about relationship between pressing force of the primary transfer roller and tension of the intermediate transfer belt.

FIG. 3 is a diagram for illustrating the relationship between tension of the intermediate transfer belt and pressing force of the primary transfer roller.

In FIG. 3, Ft represents belt tension, Fr represents pressing force of a roller against a photoreceptor and d represents a shift amount for a primary transfer roller.

Experiments for confirming transfer efficiency were made under the following conditions, after specifying d representing a prescribed shift amount by which the primary transfer roller is shifted downstream, Ft representing belt tension and Fr representing roller pressing force.

Photoreceptor
- Material: Organic Photoreceptor (OPC)
- Diameter: 60 mm

Intermediate Transfer Belt
- Material: PI (polyimide)
- Thickness: 0.1 mm
- Surface resistance value: $10^{12}$ Ω/□
- Circling speed: 220 mm/sec.

Primary Transfer Roller
- Material: Sponge roller
- Diameter: 20 mm
- Resistance value: $10^{17}$ Ω
- Primary transfer current: 25 μA Under the aforementioned setting, shift amount d and belt tension Ft were changed to obtain necessary roller pressing force Fr corresponding to the changed shift amount and belt tension.

Each of FIGS. 4(*a*)–4(*c*) is a graph showing relationship between a shift amount and roller pressing force wherein a parameter is tension of an intermediate transfer belt.

In FIGS. 4(*a*)–4(*c*), x-axis represents a shift amount, y-axis represents roller pressing force, mark ○ represents excellent transferability, mark Δ represents slightly poor transferability and mark x represents poor transferability.

FIG. 4(*a*) is a graph on which the relationship between shift amount d and pressing force Hr is indicated under the assumption of tension Ft=2.8 kgf. In the drawing, transferability is excellent in the area above the straight line of y=0.25x−0.3.

FIG. 4(*b*) is a graph on which the relationship between shift amount d and pressing force Hr is indicated under the assumption of tension Ft=5.0 kgf. In the drawing, transferability is excellent in the area above the straight line of y=0.35x−0.3.

FIG. 4(*c*) is a graph on which the relationship between shift amount d and pressing force Hr is indicated under the assumption of tension Ft=9.0 kgf. In the drawing, transferability is excellent in the area above the straight line of y=0.55x−0.3.

From the results of the experiments mentioned above, a straight line having relationship of Ft (y-axis)=αd (x-axis)−0.3 is assumed for the tension (α: constant).

FIG. 5 is a graph showing relationship between an inclination (constant) and tension obtained from the results of the experiments shown in FIGS. 4(*a*), 4(*b*) and 4(*c*).

When values of constant α and tension Ft are marked respectively on y-axis and x-axis, a straight line α=0.05 Ft+0.11 is obtained, and relationship between tension Ft (x-axis) and constant α(x-axis) is shown in a form of the graph. Fr=(0.05 Ft+0.11) d−0.3 is derived from that graph.

It is therefore possible to secure excellent transferability by satisfying the relationship of tension Ft of an intermediate transfer belt, pressing force Hr of a transfer roller and shift amount d, under the condition of Fr≧(0.05 Ft+0.11) d−0.3.

Next, image forming process will be explained as follows, referring to FIG. 1.

Simultaneously with the start of image recording, photoreceptor 10 for color signal Y is rotated counterclockwise as shown with an arrow by the start of an unillustrated photoreceptor driving motor, and concurrently with this, charging actions of scorotron charger 11 starts giving potential to photoreceptor 10.

After the photoreceptor 10 is given potential, writing of images corresponding to image data for Y is started by writing unit 12, and electrostatic latent images corresponding to images for Y among document images are formed on the photoreceptor 10.

The electrostatic latent image mentioned above is subjected to reversal development conducted by developing unit 13 for Y under the non-contact basis, thus, toner images for Y are formed on the photoreceptor 10 as it rotates.

The toner images for Y formed on the photoreceptor 10 are transferred onto intermediate transfer belt 20 by actions of primary transfer roller for Y 25.

After that, the photoreceptor 10 is cleaned by cleaning unit 14 to be ready for the succeeding image forming cycle (hereinafter, the explanation will be omitted for cleaning processes for M, C and K, because they are the same as the foregoing).

Then, color signals M for M (magenta), namely, writing of images corresponding to image data for M is conducted, and electrostatic latent images corresponding to images for M among images of document are formed on the surface of the photoreceptor 10. These electrostatic latent images are made to be toner images for M on the photoreceptor 10 by developing unit 13 for M, and these toner images are synchronized with the toner images for Y on the intermediate belt 20 at the primary transfer roller 25 for M, and are superposed on the toner images for Y.

In the same process as in the foregoing, toner images for C (cyan) are synchronized with the superposed toner images for Y and M and are superposed on the superposed toner images for Y and M at the primary transfer roller 25 for C, and further, toner images for K (black) are synchronized with the superposed toner images for Y and M and are superposed on the superposed toner images for Y, M and C and superposed on the superposed toner images for Y, M and C at the primary transfer roller 25 for K, thus, the superposed toner images for Y, M, C and K are formed on the intermediate transfer belt 20.

The intermediate transfer belt 20 carrying the superposed images is moved counterclockwise as shown with an arrow, and thereby, transfer material P is fed out of sheet cassette 72 by sheet-feeding roller 70, to be conveyed to timing roller 71 through conveyance roller 73, then, the transfer material is synchronized with the superposed toner images on the intermediate transfer belt 20 by the timing roller 71, and is fed to transfer area S of transfer roller 26 (which is in contact with the intermediate transfer belt 20) impressed with DC voltage with polarity opposite to that of toner, and thereby, the superposed toner images on the intermediate transfer belt 20 are transferred onto transfer material P.

After that, the intermediate transfer belt 20 runs, and electric charges of residual toner thereon are weakened by neutralizing roller 27, and the intermediate transfer belt 20 is cleaned by cleaning blade 29 that is in contact with the intermediate transfer belt, to be ready for the succeeding image forming cycle. The transfer material P onto which the superposed toner images are transferred is further fed to fixing unit 4 where the transfer material is interposed between heating roller 41 and presser roller 43 through fixing belt 40 to be pressed and fixed. The transfer material P on which the toner images are fused and fixed is conveyed to sheet ejection tray 82 by sheet ejection roller 81.

Pressing force Fr of the primary transfer roller against a photoreceptor, shift amount d in the direction of circling and tension Ft of an intermediate belt are prescribed in terms of relationship, and excellent transferability can be secured.

What is claimed is:

1. An image forming apparatus comprising:

(a) an image carrier on which a toner image is formed;

(b) an intermediate transfer belt that is trained about a plurality of rollers, provided at a position in contact with the image carrier; and (c) a primary transfer roller provided to face the image carrier through the intermediate transfer belt for transferring the toner image on the image carrier onto the intermediate transfer belt, wherein the following expression is satisfied, $$Fr \geqq (0.05 \times Ft + 0.11) \times d - 0.3$$

where Ft (kgf) represents a tension of the intermediate belt, Fr (kgf) represents pushing force of the primary transfer roller, and d (mm) represents a shift amount between the image carrier and the primary transfer roller.

2. The image forming apparatus of claim 1, wherein the primary transfer roller is positioned downstream of a contact point between the image carrier and the intermediate transfer belt in a rotational direction of the image carrier, and the following expression is satisfied, $$1.5 \leqq d \leqq 1.0.$$

3. The image forming apparatus of claim 1, further comprising a first roller and a second roller provided immediately upstream and downstream respectively of the contact point, about which the intermediate belt is trained, wherein the following expression is satisfied, $$0 \leqq H \leqq 10.0$$

where H (mm) represents a protrusion amount of the image carrier against a straight line connecting a contact point between the first roller and the intermediate belt and a contact point between the second roller and the intermediate belt.

4. The image forming apparatus of claim 1, wherein a surface resistance value of the intermediate belt is $10^7$ to $10^{13}$ Ω/square.

5. The image forming apparatus of claim 1, wherein a resistance value of the primary transfer roller is $10^5$ to $10^9$ Ω, and the primary transfer roller comprises a resilient layer on an outer circumferential surface thereof.

* * * * *